United States Patent [19]

Beckman

[11] 4,270,666

[45] Jun. 2, 1981

[54] CLOSURE SEAL FOR CONTAINERS

[75] Inventor: Glenn B. Beckman, Dover, Pa.

[73] Assignee: Susquehanna Broadcasting Company, York, Pa.

[21] Appl. No.: 113,304

[22] Filed: Jan. 18, 1980

[51] Int. Cl.[3] ..... B65D 39/00

[52] U.S. Cl. ..... 215/364; 215/260

[58] Field of Search ..... 215/355, 364, 260; 220/287, 358

[56] References Cited

U.S. PATENT DOCUMENTS

| | | | |
|---|---|---|---|
| 39,327 | 7/1863 | Reid | 215/357 |
| 481,363 | 8/1892 | Macauley | 215/357 |
| 521,779 | 6/1894 | Boley | 215/364 X |
| 633,468 | 9/1899 | McCarty | 215/364 X |
| 754,977 | 3/1904 | Dopheide | 215/364 |
| 1,842,226 | 1/1932 | Williams | 215/364 X |
| 2,339,827 | 1/1944 | White . | |
| 2,441,918 | 5/1948 | Hoge . | |
| 2,982,433 | 5/1961 | Chaplin . | |

*Primary Examiner*—Donald F. Norton
*Attorney, Agent, or Firm*—C. Hercus Just

[57] ABSTRACT

A container comprising a jar which has a cylindrical throat or neck and a closure including a closure body having a laterally extending circular rim of greater diameter than said neck and a cylindrical wall of less diameter than that of said neck depending from said rim and providing an annular space between said neck and closure wall, said wall having a grooved annular seat adjacent the outer end thereof, and an initially flat circular sealing gasket having an inner diameter slightly less than the innermost diameter of said seat and a thickness substantially equal to the width of the innermost surface of said seat, the outer diameter of said gasket being greater than that of the inner diameter of said neck of said jar and said gasket being disposed with the inner edge thereof in said seat in a manner to distort said gasket from a flat shape into a relatively frusto-conical shape of limited height and the outer edge extending upwardly toward said rim of said closure and outwardly a greater distance than the inner surface of said neck, whereby when said closure is in closed position in said neck the outermost portion of said sealing gasket has a flexible sealing engagement with the inner surface of said neck of said jar.

4 Claims, 4 Drawing Figures

CLOSURE SEAL FOR CONTAINERS

BACKGROUND OF THE INVENTION

Providing effective seals in containers, such as jars or bottles, as well as crocks, with respect to the closure therefor, has been a problem that has confronted many manufacturers and designers, as well as users of such bottles and jars, for many years. In general, yieldable or compressible gaskets of various kinds, such as rubber, have been utilized and have been connected to stoppers and closures in many such solutions to the sealing problem, such connections usually rendering the sealing member movable with the closure incident to attaching the cap or closure to the bottle or jar, as well as removing the same therefrom. In substantially all such gasket arrangements, at least a portion thereof is compressed between opposing surfaces in the neck or rim of the jar or bottle and the closure or stopper connected thereto, various means being employed where necessary to maintain the gasket compressed between said opposing surfaces. Typical examples of such gasket type sealing means employed in bottles and jars heretofore are found in the following U.S. patents in which the gasket or sealing member is compressed between inner surfaces of the bottles or jars and the opposed surfaces on the stopper or cap:

U.S. Pat. No. 39,327; Reid; July 21, 1863
U.S. Pat. No. 481,363; Macauley; Aug. 23, 1892
U.S. Pat. No. 521,779; Boley; June 26, 1894
U.S. Pat. No. 633,468; McCarty; Sept. 19, 1899
U.S. Pat. No. 754,977; Dopheide; Mar. 22, 1904

In the following U.S. patents, the sealing gaskets are carried by the cap member and engage the outer surfaces of the necks or rims of jars or similar containers:

U.S. Pat. No. 2,339,827; White; Jan. 25, 1944
U.S. Pat. No. 2,441,918; Hoge; May 18, 1948
U.S. Pat. No. 2,982,433; Chaplin; May 2, 1961

Among the above-listed patents, those to Macauley, Boley and McCarty have circumferential grooves in the stoppers which are in a plane perpendicular to the axis of the stoppers and receive the inner portions of the elastic sealing members which initially flare upward and outward for engagement with the inner surfaces of the necks of bottles and jars and are compressed between the same and said stoppers so as to effect an air-tight seal, whereby no flaring of the sealing member occurs when sealed.

In the patent to Reid, a rubber band r flares upward and outward against the correspondingly flared surface on the stopper g so that there is no opportunity for the outer edge of the ruuber band seal to flex independently of the seat in the stopper in view of the fact that it is compressed between opposing surfaces when the stopper is in sealing relationship with the neck of the container.

It is now quite common and popular in kitchens, pantries and the like, to provide jars or cannisters for storing such commodities as sugar, flour, tea, coffee, crackers, cookies, and otherwise. For purposes of readily removing the closures for such jars and cannisters, it is preferable that no appreciable compression of the sealing gasket occur between the neck or rim of the jar or cannister, or other type of container, and the top or closure member, although it is desirable to have an effective sealing arrangement therebetween. One fairly common type of such sealing means used at present is a flat ring of rubber disposed against a horizontal flange in a cover or closure for flat engagement with the terminal end of the neck of the jar or cannister in a manner which primarily prevents physical contact between such flange and terminal end, but due to manufacturing irregularities, there generally is no truly continuous seal afforded by such arrangement. Especially in storing such items as cookies and crackers, it is desirable to have the contents of such jars or cannisters actually sealed against the inlet of ambient atmosphere but without effecting a type of sealing which requires the exertion of any substantial force to remove the cover or lid from the neck of the jar or cannister. Accordingly, it is the principal object of the present invention to provide a sealing means between a cover or lid of a jar or cannister or other similar container which provides actual continuous sealing around the entire perimeter of the neck of the container and the lid or closure, while simultaneously permitting ready removal of said lid or closure without the exercise of any undue force or other unlocking movement, as set forth below.

SUMMARY OF THE INVENTION

The principal objective of the present invention is to provide a container comprising a jar having a neck provided with a substantially cylindrical inner surface and a closure having a body complementary in cross-section to that of said neck, said body being provided with a laterally extending rim of greater diameter than that of the inner surface of said neck and also having a substantially cylindrical wall on said closure of less diameter than said cylindrical inner surface of said neck of the jar which depends from said rim to provide an annular space of predetermined thickness between said wall and cylindrical inner surface of said neck, said cylindrical wall having an annular V-shaped seat formed therein adjacent the outer end thereof, and a flexible initially flat circular sealing gasket of less thickness than said annular space and an inner diameter less than the innermost diameter of said seat, the outer diameter of said gasket also being substantially greater than the diameter of said cylindrical inner surface of said neck, the inner edge of said gasket being disposed in said seat to connect the same to the closure and also stretch said inner edge portion of said gasket to distort the initially flat gasket into a generally frusto-conical shape in which said gasket projects outward and upward toward the rim of said closure at an angle of about 45° to the cylindrical wall thereof and outward a greater distance than the diameter of said cylindrical inner surface of said neck, whereby when said closure is in closed position in said neck of the jar, the outermost portion of said sealing gasket has limited floating and flexible wiping contact with the entire circumference of the inner surface of the neck of said jar effectively to seal the interior thereof in air-tight manner and also compensate for limited variations in the manufactured diameters of the necks of similar jars and/or covers, as well as variations in roundness of said jar necks and/or covers.

It is another object of the invention to form said annular grooved seat in the nature of a channel having opposite sides disposed at an angle varying between approximately 2° or 3° and substantially 30° and the bottom of said groove being narrow and relatively flat and having a width preferably substantially equal to the thickness of said gasket to form a firm seat for the inner edge thereof.

A further object of the invention is to form the side of said grooved seat in said wall of the closure which is nearest the rim thereof so as to comprise a support for said gasket but said side of said seat being no greater than substantially one-fourth the width of said gasket, whereby the majority of the width of said gasket is free to floatingly flex upwardly for engagement with said cylindrical inner surface of the neck of the jar and thereby compensate for said aforementioned limited variations in diameters of jar necks and/or covers, as well as variations in roundness thereof.

Still another object of the invention is to form the opposite side of said grooved seat so as to extend downwardly at substantially the same angle to a horizontal plane as said side of said seat nearest to the rim which extends upwardly and said sides being disposed to each other at an angle no greater than substantially 30° therebetween.

The terminal end of said wall of said closure below said seat also tapers inward at an angle approximately 45° from the cylindrical outer surface of the wall to minimize engagement between the lower end of said wall of said closure and the rim of the neck of the jar incident to said closure being seated in sealed manner within said neck.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENTS

As indicated above, the present invention pertains to a container comprising in combination, a jar made from any suitable material, such as glass, ceramic, or the like, having a neck provided with a substantially cylindrical inner surface, a closure having a downwardly extending wall of less diameter than the inner surface of the neck of the jar so as to provide a space therebetween in order to compensate for manufacturing differences in diameter and roundless of both said neck and wall of the closure and utilizing a readily flexible seal of yieldable material connected to said wall of the closure and being initially flat but mounted in such a way as to be frustoconical in an upwardly extending manner so as readily to compensate for any limited variations in manufacturing diameters or departures from roundness in both the neck of the jar and the cover, but, nevertheless, effect a true seal to prevent the ingress of ambient atmosphere to the contents of the container.

Figure 1:
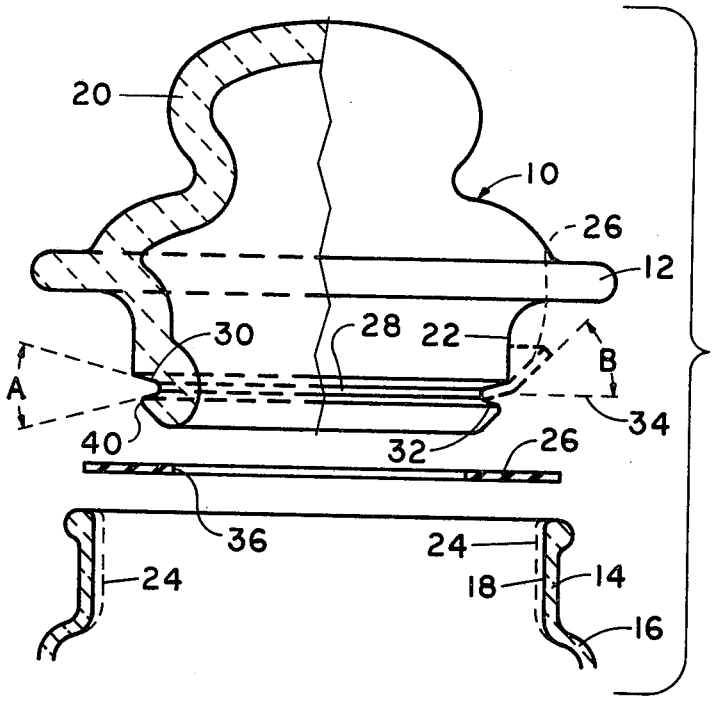
FIG. 1 is an exploded vertical elevation showing fragmentarily the upper portion of a jar and a closure which is partially vertically sectioned to show details, together with a flat gasket shown in full lines, and in phantom, said gasket being shown at one side of said closure in cross-section in the actual shape it assumes when installed, the opposite side of said closure also showing angle designations of the seat groove.

Referring to the drawings, it will be seen from FIG. 1, which is an exploded concept of the present invention that a molded cap or closure 10 is provided with a laterally extending rim 12 of greater diameter than the neck 14 of the jar 16. The neck 14 has an inner cylindrical surface 18 which is complementary to and of larger diameter than the body of the closure 10, the upper portion of which comprises a knob 20 and the portion below the rim 12 is a cylindrical wall 22 having a diameter less than the inner surface 18 of the neck 14 of the jar 16. It will be understood that the term "jar" is intended in this description and the appended claims to be generic and encompass various sizes and shapes of containers, especially containers made from glass, ceramic products, and materials susceptible to chipping. However, the invention also is applicable to containers made from metal or appropriate synthetic resins or plastics, particularly any type of material which, during the formation thereof, is subject to variations in diameters of such necks or in departures from accurate roundness due to the impossibility of actually controlling such dimensions and shapes precisely.

In one practical and desirable application of the invention, the jar 16 is made from glass so as to render the contents of the jar readily visible but it is obvious that such jar similarly could be made from synthetic resin or plastics of a transparent nature for the same purpose. Also, with such transparent jars, a preferably opaque type of closure 10 is provided which may be made from an opaque glass or suitably colored ceramic material or porcelain. When, for example, the closure 10 is formed from ceramic material and a white glaze is applied thereto, a very smart and attractive combination of closure and jar is the result but such proposals are to be considered primarily illustrative rather than restrictive.

Referring to FIG. 1, it will be seen that adjacent the inner cylindrical surface 18, dotted lines 24 are shown, which are intended to indicate variations in the diameter of said inner surface and/or the roundness thereof, while, in general, variations in the diameter and/or roundness of the cylindrical wall 22 of the closure 10, when suitably molded from ceramic slip, glazed and fired, will also vary but not to the same degree that the neck 14 of glass jars, for example, will vary in diameter and roundness.

A seal between the wall 22 of the closure and inner cylindrical surface 18 of the jar neck is provided in the form of an initially flat flexible sealing gasket 26. One appropriate material which has been found to be satisfactory from the standpoint of function, as well as government standards, is an FDA approved Neoprene rubber, having a thickness of 1/16 inch but said thickness is illustrative rather than restrictive and is determined in relationship to the grooved seat 28 which actually comprises a circular groove defined by at least a slightly upwardly extending side 30 and a lower, at least slightly downwardly extending side 32, the angle A therebetween being between substantially 2° or 3° and approximately 30°, as shown in the illustration of closure 10 in FIG. 1. In the preferred construction of the groove forming the annular seat 28, the upper and lower sides 30 and 32 thereof respectively extend at a substantially equal angle of between 2° and 15° to a horizontal plane 34, shown in FIG. 1, to which the axis of the closure 10 is perpendicular, whereby there preferably is an angle of approximately between about 5° and 30° between said sides 30 and 32.

The inner diameter 36 of the sealing gasket 26 is a limited amount less than the diameter of the base or root of the groove comprising the seat 28, whereby when the initially flat gasket 26 is mounted upon the wall 22 with the inner edge of the gasket disposed in the root or base of the seat 28, said gasket will be deformed from its initially flat condition to an upwardly extending, frusto-conical shape shown in phantom at the right-hand edge of the wall 22 in FIG. 1. In general, depending upon the material from which the gasket is formed and the difference in diameters between the central opening of the gasket and the base diameter of the seat 28, the portion of the gasket 26 which extends beyond the confines of the seat 28, will be disposed substantially at an angle B of between approximately 30° and 45° to the horizontal plane 34 as indicated diagrammatically at the right-hand side of the closure 10, as viewed in FIG. 1.

The thickness of the sealing gasket 26 preferably is substantially equal to the width of the base or root surface of the seat 28 so as to snugly engage said seat and effect a firm connection between the gasket and closure incident to both disposing the closure in closed engagement with the neck 18 or in removing the closure therefrom. To effect the desired sealing in accordance with the principles of the invention, however, in no instance is the width of space 37 less than the thickness of the gasket, the space 37 being circular and between the inner cylindrical surface 18 of the neck 14 and the cylindrical wall 22 of the closure 10. One practical thickness of the gasket which has been found to be highly suitable is 1/16 inch, but this dimension is to be considered illustrative rather than restrictive. Further, when the closure comprising jar 16 is formed of transparent material, a white gasket 26 is very suitable from an aesthetic standpoint.

Figure 3:
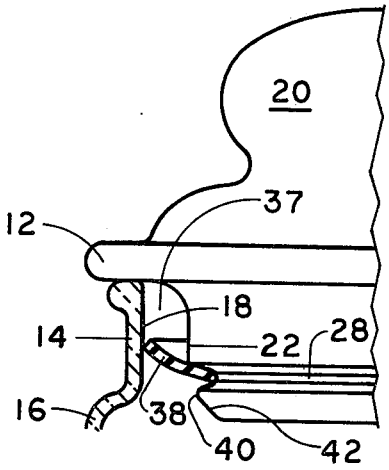
FIGS. 3 and 4 respectively are fragmentary illustrations of one side of the neck of a jar enclosure respectively illustrating a wider space between said neck and jar wall and a narrower space between said neck and jar wall relative to the illustration shown in FIG. 2 to illustrate adaptability of the gasket in various space dimensions.
Figure 4:
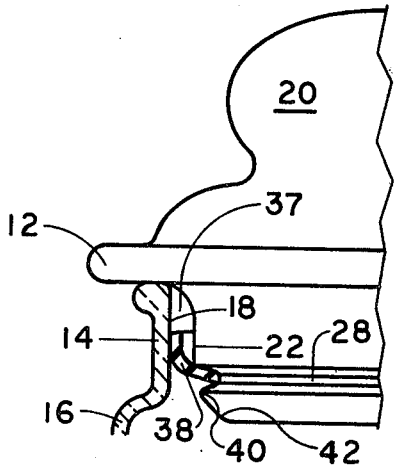

The outer diameter of gasket 26 is greater than the anticipated range of diameters of the cylindrical inner surface 18 of the neck 14 of the jar 16 by a predetermined amount in accordance with a chart set forth hereinbelow which comprises actual typical dimensions of the critical diameters of both the closure and jar which includes the invention and for purposes of illustrating the effectiveness of the sealing provided by the invention. In view of such larger outer diameter of the gasket 26, when the wall 22 of the closure 10 is inserted in the neck 14, the outer portion 38 of said gasket extends radially beyond the seat appreciably to an extent which preferably is about three times as great as the inner portion of the gasket which is held within the grooved seat and is disposed against the upper side 30 of the seat 28, said outer portion of the gasket being flexed upwardly from the normal frusto-conical shape to various greater extents in use, depending upon the width of the annular space 37 between the wall 22 of the closure 10 and the inner surface 18 of the neck 14 of the jar. This is illustrated to various degrees respectively in FIGS. 3–4, wherein it will be seen in FIG. 2 that the space 37 is of average width, whereas in FIG. 3, said space is wider than shown in FIG. 2, and in FIG. 4, the space 37 is narrower than in the preceding figure. Nevertheless, because of the flexibility and the larger outer diameter of the gasket than the inner diameter of the inner surface 18 of the neck 14, complete actual sealing engagement is effected between the gasket and neck 14 of the jar 16 in order especially to compensate for any variations in manufactured diameters of the inner surface 18 of the jar, as well as the diameter of the substantially cylindrical wall 22 of the closure 10, and also departures from roundness of said respective items. Moreover, the flexible wiping contact between said gasket and cylindrical inner surface 18 permits a somewhat limited amount of floating coengagement between the closure 10 and the jar 16 and, indeed, the portion of the gasket which extends beyond the seat 28 may be actually considered to be somewhat "floppy" but, nevertheless, has sufficient stiffness to always exert a sealing engagement of the perimeter of the gasket with the inner surface 18 of the neck 14.

Further contributing to the ease of inserting the closure in the neck of the jar is the fact that the terminal end surface 42 on the end 40 of the wall 22 is bevelled inwardly and downwardly at an angle of somewhere in the vicinity of approximately 45° to the vertical axis of the closure 10, whereby if the closure is carelessly applied to the neck 14 of the jar 16, said conical configuration of the end surface 42 will aid in camming the closure into the neck.

To provide a practical appreciation of the differences in diameters of the rim 12, wall 22, innermost diameter of seat 28, and the wall end 40, relative to suitable I.D. and O.D. of gaskets for certain typical sizes of a range of different transverse dimensions of jars and closures, and further, with relation to the I.D. of the neck 14, the following chart is included to illustrate the interrelationship of such diameters:

CHART

| JAR DATA (In Inches) | | CLOSURE DATA (In Inches) | | GASKET DATA (In Inches) | |
|---|---|---|---|---|---|
| Jar No. | Jar Neck I.D. | Wall Dia. | Groove Dia. | I.D. | O.D. |
| A | 2⅞–2 15/16 | 2 7/32–3 9/32 | 2–2 1/16 | 1⅞ | 3 |
| B | 3 19/32–3 21/32 | 2 31/32–3 | 2¾–2 25/32 | 2 9/16 | 3¾ |
| C | 5 21/32–5 25/32 | 4 31/32 | 4⅝–4¾ | 4½ | 6 |
| D | 7½–7¾ | 6 29/32–6 31/32 | 6⅝–6 11/16 | 6 7/16 | 7¾ |

It will be seen from the foregoing chart that as the diameters of the closures increase in the exemplary different sizes of jars shown in the above chart, the difference in diameters between the wall 22 and I.D. of the neck 18, gradually increases, whereby the O.D. of the gasket similarly increases so that the proportions between the various interfitting elements which produce the sealing effect are similar with respect to the various sizes of jars and closures.

Figure 2:
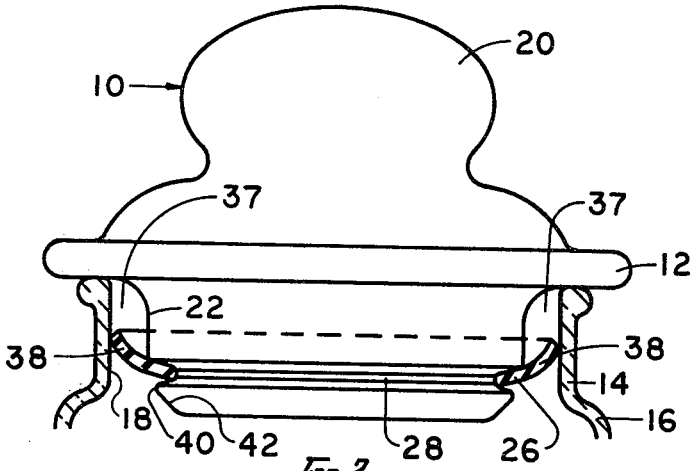
FIG. 2 is a vertical elevation showing a fragmentary neck portion of an exemplary jar with the closure disposed therein in sealing engagement and the gasket being illustrated in the shape it assumes with one exemplary diameter of jar neck.

When inserting the closure in the neck of the jar, it frequently occurs that there is a tendency to compress the air contained in the jar and it is preferable that at least a portion of the compressed air readily can escape past the gasket incident to fully disposing the wall 22 into the neck so that the rim 12 preferably engages the upper terminal surface of the neck 14, as shown in FIG. 2, for example. Accordingly, the greater width of the outer portion 38 of the gasket relative to the portion thereof which is actually disposed in the seat 28, readily is capable of permitting such escape of internal pressure, but upon the same occurring, the inherent resilience of the gasket will dispose the outer terminal edge in sealing engagement with the cylindrical inner surface 18 of the neck 14. Such escape also is necessary in order to prevent such internal pressure from blowing the cover away from being seated within the neck 14. Also, the depth of the seat 28 preferably is such as to effectively retain the inner edge of the gasket in said seat, while the lower frusto-conical side 32 of the seat 28 preferably is wide enough to effectively retain the inner edge of the gasket in the seat and thereby provide the decreasing diameter of the end 40 of wall 22 for purposes of facilitating the introduction of the closure into the neck 14 of the jar, as described above. In addition, from the foregoing, it also can be appreciated that the gasket is readily removable from the closure for cleaning purposes.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A container comprising in combination, a jar having a neck provided with a substantially cylindrical inner surface, a closure having a body provided with a laterally extending rim of greater diameter than the diameter of said cylindrical inner surface of said neck of said jar, a substantially cylindrical wall on said closure of less diameter than said cylindrical inner surface of said neck of said jar depending from said rim to provide an annular space between said wall and cylindrical inner surface of said jar, an annular grooved seat formed in said wall adjacent the outer end thereof, a flexible initially flat circular sealing gasket of less thickness than said annular space and an inner diameter less than the innermost diameter of said seat and the outer diameter being substantially greater than the diameter of the cylindrical inner surface of said neck of said jar and the inner edge of said gasket being disposed in said seat to connect the same to said closure and also stretch said inner edge portion of said gasket to distort said flat gasket into a generally frusto-conical shape in which said gasket projects outward and upward toward said rim of said closure at an angle of between approximately 30° and 45° to a plane perpendicular to said cylindrical wall and outward a greater distance than the diameter of said cylindrical inner surface of said neck of said jar, whereby when said closure is in closed position in said neck of said jar the outermost portion of said sealing gasket has an inner surface extending upward and outward so as to be spaced from the cylindrical wall of said closure to provide limited floating and flexible wiping contact with the entire circumference of the inner surface of the neck of said jar, thus effectively to seal the interior of said jar in air-tight manner and also compensate for limited variations in the manufactured diameters of the necks of similar jars and/or covers, as well as variations in roundness of said jar necks and/or covers.

2. The container according to claim 1 further characterized by the opposite walls of said annular grooved seat in said wall of said closure being at an angle of between approximately 2° and 30° therebetween and the bottom of said groove being narrow and having a width substantially equal to the thickness of said gasket to form a firm seat for the inner edge of said gasket.

3. The container according to claim 1 in which the side of said grooved seat in said wall of said closure nearest said rim thereof comprises a support for said gasket and said side being no greater than substantially one-fourth the width of said gasket, whereby the majority of the width of said gasket is free to floatingly flex upwardly for engagement with the cylindrical inner surface of the neck of said jar and thereby compensate for said aforementioned limited variations in diameters of jar necks and/or covers as well as variations in roundness thereof.

4. The container according to claim 3 in which the opposite side of said seat in the wall of said closure extends downwardly and substantially at the same angle to a horizontal plane as said side nearest to said rim extends upwardly and said sides being disposed to each other substantially at an angle between approximately 2° and 30°, and the terminal end of said wall of said closure below said seat tapering inward at an angle of approximately 45° from the cylindrical outer surface of said wall to minimize engagement between the lower end of said wall of said closure and the rim of the neck of a jar incident to said closure being seated in sealed manner within said neck.

* * * * *